US007441492B2

(12) United States Patent
Frey

(10) Patent No.: US 7,441,492 B2
(45) Date of Patent: Oct. 28, 2008

(54) ECCENTRIC DRIVE MECHANISM FOR VOLUMETRIC PUMPS OR MOTORS

(76) Inventor: Bernhard Frey, Freistrasse 2, 8200 Schaffhausen (CH)

( * ) Notice: Subject to any disclaimer, the term of this patent is extended or adjusted under 35 U.S.C. 154(b) by 108 days.

(21) Appl. No.: 10/563,670

(22) PCT Filed: Jul. 6, 2004

(86) PCT No.: PCT/EP2004/007352

§ 371 (c)(1),
(2), (4) Date: May 11, 2006

(87) PCT Pub. No.: WO2005/003558

PCT Pub. Date: Jan. 13, 2005

(65) Prior Publication Data

US 2006/0245940 A1 Nov. 2, 2006

(30) Foreign Application Priority Data

Jul. 7, 2003 (DE) ..... 103 30 757

(51) Int. Cl.
*F01B 1/00* (2006.01)
*F01B 31/10* (2006.01)

(52) U.S. Cl. ..... 92/72; 92/156

(58) Field of Classification Search ..... 92/72, 92/129, 153, 156; 91/491; 417/273
See application file for complete search history.

(56) References Cited

U.S. PATENT DOCUMENTS 3,093,301 A * 6/1963 Orville ..... 92/154
3,456,874 A 7/1969 Graper
3,519,370 A * 7/1970 Bleuel ..... 92/153
4,132,510 A 1/1979 Takahashi
4,567,815 A * 2/1986 Kocher ..... 92/157
5,493,952 A * 2/1996 Daniel et al. ..... 92/72

FOREIGN PATENT DOCUMENTS

| | | |
|---|---|---|
| CN | 1151479 | 6/1997 |
| DE | 3039197 | 5/1982 |
| DE | 19906626 | 4/2000 |
| GB | 740784 | 11/1955 |
| GB | 8845556 | 12/1961 |

* cited by examiner

*Primary Examiner*—Michael Leslie
(74) *Attorney, Agent, or Firm*—Pearl Cohen Zedek Latzer, LLP

(57) ABSTRACT

Drive mechanism having stroke member (HG) fixed to shaft (W) of a mechanism having eccentric bearing (HL) which connects stroke member (HG) to coupling member (KG) connected by transverse bearing (QL) to pressure member (DG). Included is pressure source (DQ) for fluid lubricant connected to transverse bearing (QL). This connection includes first passage (K1) extending through stroke member (HG) into eccentric bearing (HL) and second passage (K2) extending from eccentric bearing through coupling member (KG) into transverse bearing (QL). A space arrangement provides for conduction of the fluid lubricant to second passage (K2), this space arrangement having an arrangement permitting a flow of the fluid lubricant between first and second passages The applications has been limited to unidirectional pumps. (K1,K2) only within low pressure phases of the fluid lubricant. Space arrangement is in bearing surface (L1) of stroke member (HG) and extends over part of peripheral section (UN) of stroke member (HG) corresponding to low pressure phase.

5 Claims, 4 Drawing Sheets

ECCENTRIC DRIVE MECHANISM FOR VOLUMETRIC PUMPS OR MOTORS

PRIOR APPLICATION DATA

Figure 1:
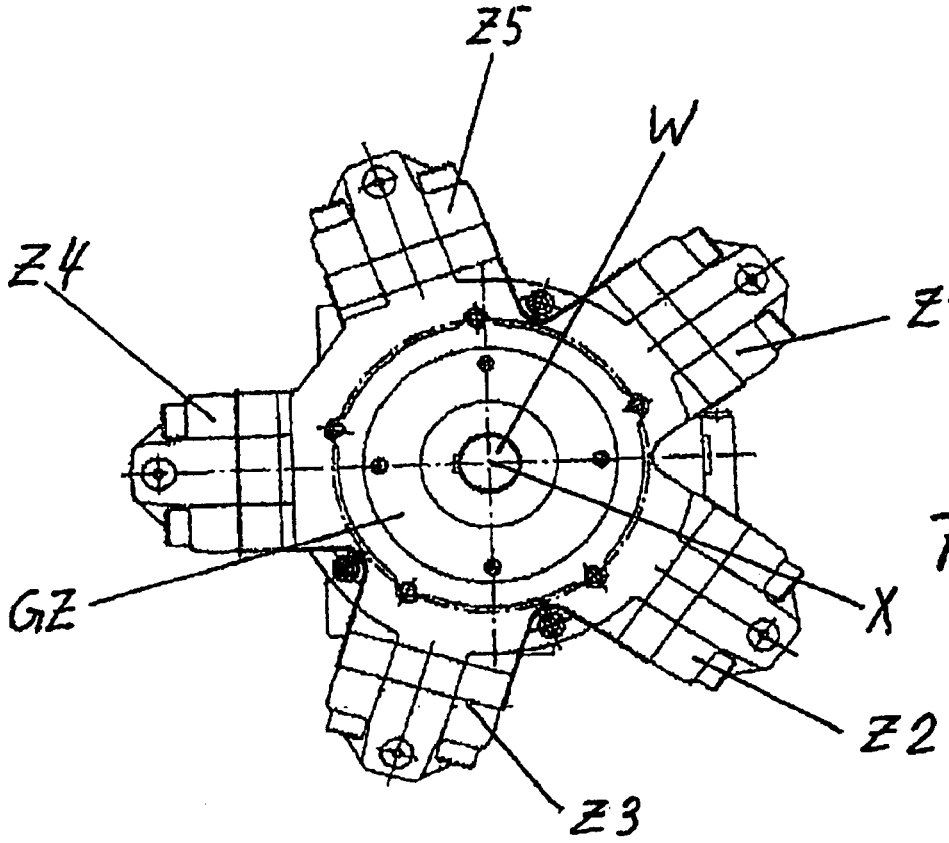

The present application is a national phase application of International Application No. PCT/EP2004/007352, entitled "ECCENTRIC DRIVE MECHANISM FOR VOLUMETRIC PUMPS OR MOTORS", with international filing date, Jul. 6, 2004, which in turn claims priority from German application No. 103 30 757.5, filed on Jul. 7, 2003.

The invention relates to an eccentric drive mechanism for volumetrically acting unidirectional pumps having the features of claim 1. Such drive mechanisms are known in the prior art.

The stroke member, which is rotationally fixedly connected to the shaft of the crank mechanism with its stroke bearing eccentric relative to the axis of this shaft, can, for example, be formed as a crank spigot of a customary crankshaft, the coupling member can be formed as a conrod and the pressure member can be formed as a piston which is pivotally connected to the conrod by a piston pin. The crank spigot/conrod bearing and the piston pin bearing together form a support with a degree of translational freedom directed transversely to the hub, i.e. a transverse bearing. A passage or bore system can then be considered for the supply of lubricating fluid to the transverse bearing which, starting from a pressure delivery source, extends through the crankshaft and the conrod to the piston pin. This lubricating fluid supply also extends to the crank spigot/conrod bearing, i.e. through the stroke bearing. In the interest of the infeeding and distribution of the lubricating fluid in the low pressure phase for the subsequent hydrodynamic formation of a lubricant film in the high pressure phase, through relative rotary movement between the bearing surfaces, groove-like cut-outs of appropriately large dimensions are provided in known manner in the bearing surfaces which surround the bearing.

However, in the respective high pressure phase, oscillating states of movement with stationary phases prevail, at least in addition to continuous relative rotary movements, between the bearing surfaces of the transverse bearing and in practice do not permit the build-up of adequately supportive hydrodynamic lubricant films. Thus, in these regions, it is not only important to introduce an adequate lubricant cushion into the bearing gap during the low pressure phases—this takes place via the stroke bearing which stands in communication with the transverse bearing—but rather it is also important not to permit this cushion to flow out too quickly in the high pressure phases. This outflow can in turn take place via the stroke bearing. Having regard to the above-mentioned cut-out in the bearing surfaces of the stroke bearing the known eccentric drive mechanisms require improvement with regard to this desired retention of lubricant pressure.

The object of the invention is thus the provision of an eccentric drive mechanism for a pump, which comprises, with respect to the bearing, effective and reliable lubrication by means of a fluid lubricant, pressure retention of the fluid lubricant, and separation of the fluid from the material to be pumped.

The way this object is satisfied is determined by the features of independent claim 1.

Preferred embodiments of the invention are defined by dependent claims 2 through 6.

In the context of the combination of these features of the solution it is, amongst other things, important that the flow connection between the transverse bearing and the passage system of the lubricating fluid supply in the high pressure phase is in each case closed by the non-interrupted bearing surfaces of the stroke bearing and thus that an undesired return flow of the lubricating fluid is prevented.

It should be emphasized that, above all with high pressure pumps and corresponding motors which have, instead of a pronounced crankshaft only an eccentric disc or a plurality of the same and also corresponding eccentric cam tracks with a purely translational sliding movement, relative to the pressure members which sit on these cam tracks, a reliable sliding lubrication and thus a high pressure operation with acceptable mechanical efficiency is made possible by the invention.

An important further development of the invention lies in the fact that the hollow space arrangement is disposed in a bearing surface of the stroke member, extends over at least a part of the peripheral section of the stroke member corresponding to the low pressure phase of the eccentric drive mechanism and has a boundary which extends at least section-wise with a spacing from the edges of this bearing surface. In this way a particularly effective seal of the hollow space arrangement against reverse flow of lubricating fluid is achieved. The same optimizing process is served by a further development in accordance with which the hollow space arrangement has at least one hollow space in the form of a groove extending at most over a semicircular peripheral section of the stroke member.

In certain applications another further development can be considered in accordance with which the hollow space arrangement includes a plurality of hollow spaces arranged offset relative to one another in the peripheral direction and/or in the axial direction of the stroke member which each stand in communication with the lubricating fluid system. This enables comparatively large cross-sections for the lubricating fluid flow with a neverless simultaneously reliable sealing against undesired reverse flow.

A likewise important further development of the concept of the invention provides that the hollow space arrangement is bounded at a front peripheral angular spacing and/or at a rear peripheral angular spacing from the front end and/or the rear end, relative to the direction of rotation, of the peripheral section of the stroke member corresponding to the low pressure phase. This enables in certain applications expedient phase shifts of the start or end of the lubricating fluid supply to the transverse bearing. In this way account can be taken of any phase shifts and/or changes of the time dependent pressure gradient which may occur as a consequence of the compressibility of the working medium. In this connection both positive and also negative angular spacings with regard to the geometrical dead centres or reversal points of the eccentric drive mechanism can be considered.

Figure 2:
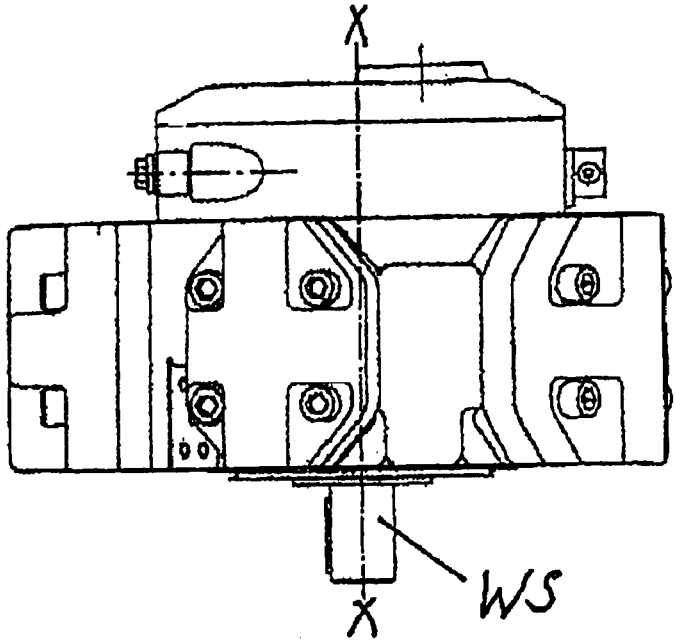
Figure 3A:
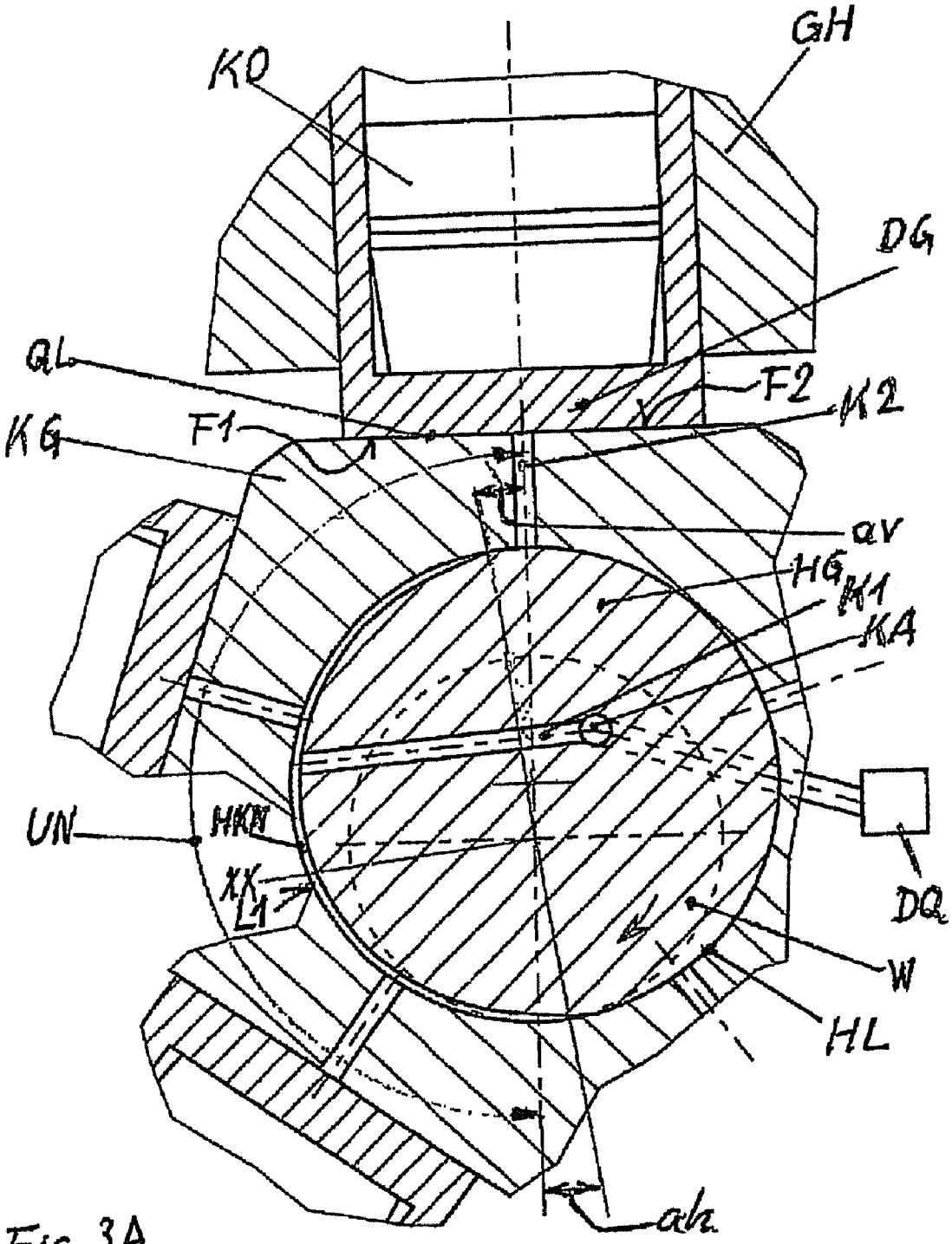
Figure 3B:
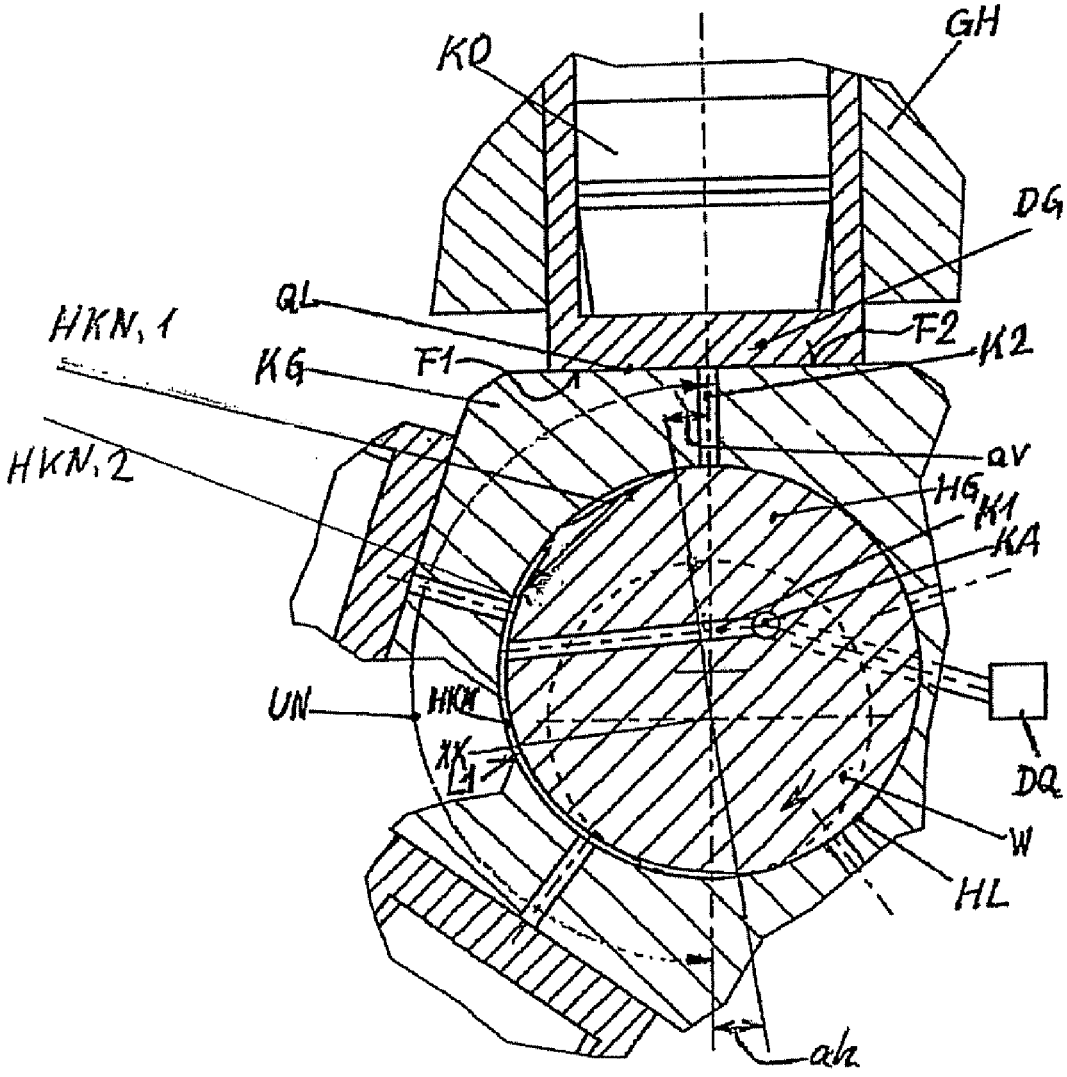
Figure 4:
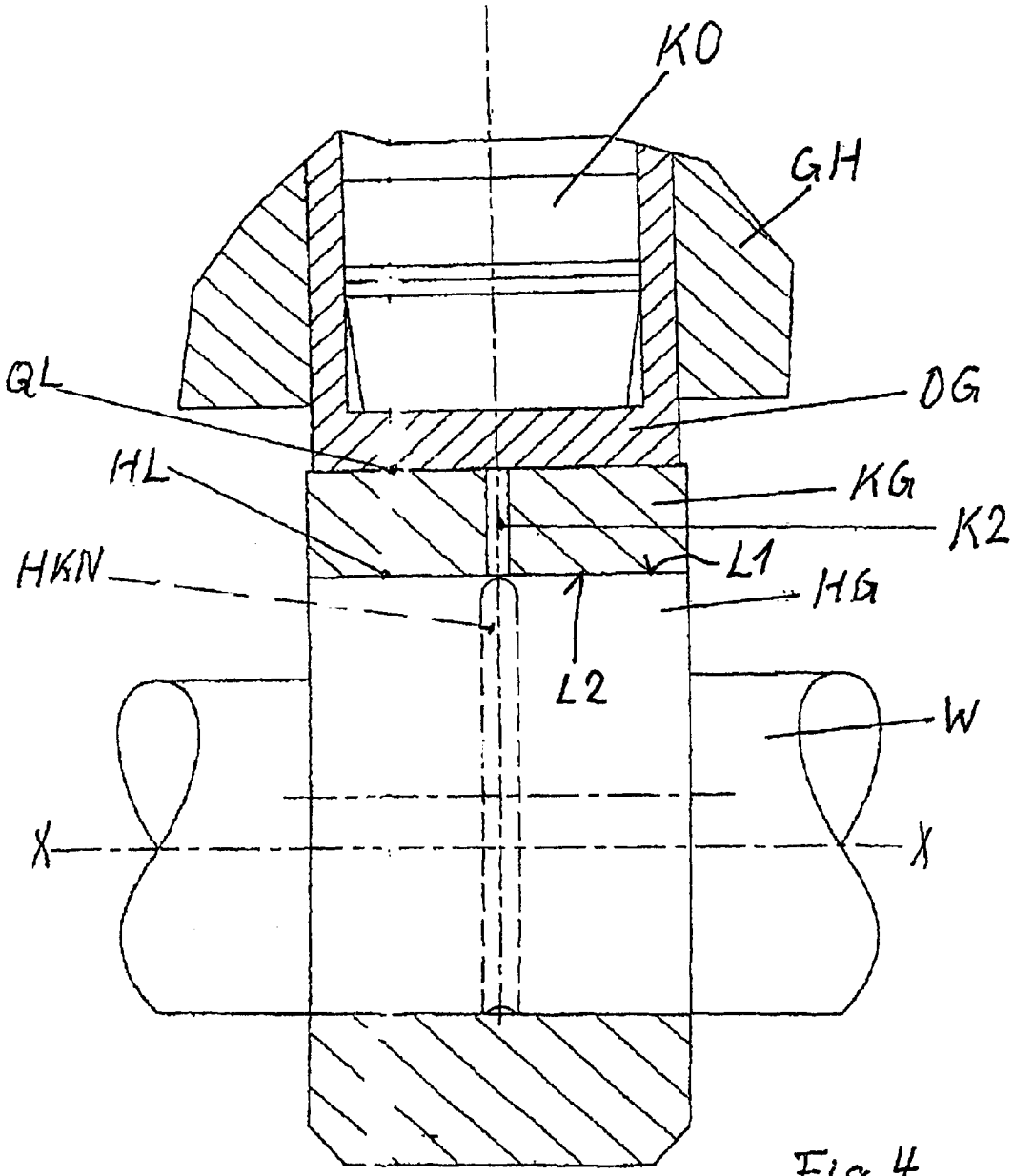

The invention will now be explained further with reference to the embodiment schematically illustrated in the drawings, in which are shown:

FIGS. 1 and 2 a radial piston machine as a preferred example of an application of the invention in an axial view and in a radial view respectively, FIG. 3 part sections of the eccentric drive mechanism of the pump in accordance with FIGS. 1 and 2 oriented transverse to the main shaft and kept to a larger scale and having one and a plurality of hollow spaces respectively, and FIG. 4 a part axial section of the eccentric drive mechanism with a partly indicated radial pressure member and the associated piston and also cylinder.

The radial piston machine of FIGS. 1 and 2 is a 5-cylinder pump with cylinder-piston units (Z1) to (Z5) driven by a shaft (W) which are arranged distributed concentrically to the axis (X-X) of the shaft (W) and uniformly distributed over its periphery. An eccentric drive mechanism which has yet to be shown in detail is located in the central housing (GZ). The drive torque is introduced from a non-illustrated motor via a stub shaft (WS).

The eccentric drive mechanism shown in FIGS. 3A, 3B, and 4 includes a stroke member (HG) which is rotationally fixedly connected to the shaft (W) and which has an eccentric stroke bearing (HL) with respect to this axis (XX) of the shaft. The stroke bearing (HL) connects the stroke member (HG) to a coupling member (KG) which does not participate in the rotary movement and which is in turn associated via a transverse bearing (QL) with a pressure member for the oscillating delivery drive mechanism of a piston-cylinder unit. In the present preferred example of an application the stroke member is a simple eccentric disc which rotationally fixedly sits on the shaft (W) or is formed in one piece with it. The stroke member forms at its outer periphery a bearing surface (L1) which sits inside a corresponding cylindrical bearing surface (L2) of the coupling member and thus forms a stroke bearing (HL). Accordingly the construction does not have any pronounced crankshaft despite the multiple cylinder arrangement.

In the example the pressure member is formed as a sleeve which is displaceably mounted radial to the shaft in a housing (GH) and in which there sits a piston (KO) which stands under working pressure. This piston presses the lower end face of the pressure member which in the example is substantially or approximately planar against a planar seat surface (F1) of the coupling member (KG) with large forces. The surfaces (F1) and (F2) as bearing surfaces together form the transverse bearing (QL). They are subject only to translatory sliding movements relative to one another. If required the lower end face of the piston itself can form the named bearing surface of the transverse bearing.

Furthermore a pressure delivery source (DQ) for lubricating fluid is provided which is connected at the output side by a channel system to the transverse bearing (QL). Starting from a connection passage (KA) connected to the pressure delivery source (DQ) the passage system includes a first passage (K1) extending through the stroke member (HG) into the stroke bearing (HL) and at least one second passage (K2) extending from this stroke bearing through the coupling member (KG) into the transverse bearing (QL).

In the region of the stroke bearing (HL) a hollow space arrangement for the further conduction of the lubricating fluid into at least one second passage (K2) is provided within the bearing surface (L1) associated with the stroke member (HG). This hollow space arrangement has within the bearing surface (L1) and in the peripheral direction of the stroke member (HG) at least approximately an arrangement and/or an extent which permits a lubricating fluid flow between the first passage and the second passage, in each case only within a low pressure phase of the lubricating fluid in the stroke bearing (HL) and in the transverse bearing (QL). This design or arrangement thus operates in the sense of a slide valve control which prevents an undesired return flow of the lubricating fluid in the high pressure phases of the transverse bearing but which ensures an adequate filling of the transverse bearing gap with lubricating fluid in the low pressure phases.

In detail the eccentric drive mechanism has a hollow space arrangement in a bearing surface (L1) of the stroke member (HG). This hollow space arrangement extends over at least a part of the peripheral section (UN) of the stroke member (HG) corresponding to the low pressure phase of the eccentric drive mechanism and has a boundary which extends at least section-wise at a spacing from the edges of this bearing surface (L1). This improves the reverse flow blocking action. In the embodiment the construction is so designed that the hollow space arrangement has at least one hollow space in the shape of a groove (HKN) extending at most over a semicircular peripheral section of the stroke member. If required the hollow space arrangement can include a plurality of hollow spaces offset in the peripheral direction and/or in the axial direction of the stroke member (HG) relative to one another. This enables comparatively large cross-sections for the lubricating fluid flow with a simultaneously reliable seal against undesired reverse flow.

The hollow space arrangement can furthermore be made so that it is bounded in a front or rear peripheral angular spacing av or ah respectively from the front and/or rear end, relative to the direction of rotation, of the peripheral section (UN) of the stroke member (HG) corresponding to the low pressure phase. This enables a phase shift of the start or end of the lubricating fluid supply to the transverse bearing. The magnitude of such a phase shift is generally expediently restricted to a value of about 10°-positive or negative.

The invention claimed is:

1. Eccentric drive mechanism for a volumetrically acting unidirectional pump including the following features:

a) at least one stroke member (HG) which is rotationally fixed to a shaft (W) of a crank mechanism having at least one stroke bearing (HL) eccentric relative to a rotational axis (XX) of the shaft (W);

b) the stroke bearing (HL) connecting the stroke member (HG) to a coupling member (KG) which does not participate in a rotary movement and which is in turn connected by a transverse bearing (QL) to at least one pressure member (DG) for a oscillating delivery drive mechanism of at least one piston-cylinder unit of the pump;

c) at least one pressure delivery source (DQ) for a fluid lubricant being connected at it's output side to the transverse bearing (QL) via a passage system;

d) the passage system, starting from a connection passage (KA) connected to the pressure delivery source (DQ), including at least one first passage (K1) which extends through the stroke member (HG) into the stroke bearing (HL) and at least one second passage (K2) which extends from the stroke bearing (HL) through the coupling member (KG) into the transverse bearing (QL);

e) a hollow space arrangement provided in the region of the stroke bearing (HL) within a bearing surface (L1) associated with the stroke member (HG) for the further conduction of the fluid lubricant fluid to the second passage (K2), the hollow space arrangement having, within the bearing surface (L1) and in the peripheral direction of the stroke member (HG), an arrangement which permits a flow of the fluid lubricant between the first passage (K1) and the second passage (K2) in each case only within a low pressure phase of the fluid lubricant in the stroke bearing (HL) and/or in the transverse bearing (QL), f) wherein the hollow space arrangement provided in the bearing surface (L1) of the stroke member (HG) extends over at least a part of a peripheral section (UN) of the stroke member (HG) corresponding to the low pressure phase of the eccentric drive mechanism, has a boundary which extends at least section-wise with a spacing from the boundaries of the bearing surface (L1), and has at least one hollow space in the form of a groove (HKN) extending along a semicircular peripheral section of the stroke member.

2. Drive mechanism in accordance with claim 1, wherein the hollow space arrangement (HKN) includes a plurality of hollow spaces (HKN.1; HKN.2) arranged offset with respect to one another in the peripheral direction of the stroke member (HG) which are connected to one another or separately to the lubricating fluid system.

3. Drive mechanism in accordance with claim 1, wherein the hollow space arrangement is bounded at a front peripheral angular spacing (av) by the front end, with respect to the direction of rotation, of the peripheral section (UN) of the stroke member (HG) corresponding to the low pressure phase of the stroke member (HG).

4. Drive mechanism in accordance with claim 3, wherein the hollow space arrangement is bounded at a rear peripheral angular spacing (ah) by the rear end, with respect to the direction of rotation, of the peripheral section (UN) of the stroke member (HG) corresponding to the low pressure phase of the stroke member (HG).

5. Drive mechanism in accordance with claim 4, wherein at least one of the peripheral angular spacings (av; ah) of the hollow space arrangement amounts to at most 10°.

* * * * *